US006605334B2

(12) United States Patent
Bettencourt

(10) Patent No.: US 6,605,334 B2
(45) Date of Patent: Aug. 12, 2003

(54) TACTICAL BODY ARMOR

(76) Inventor: Kenneth M. Bettencourt, 1042B N. El Camino Real, Suite 406, Encinitas, CA (US) 92024-1322

( * ) Notice: Subject to any disclaimer, the term of this patent is extended or adjusted under 35 U.S.C. 154(b) by 12 days.

(21) Appl. No.: 09/810,890

(22) Filed: Mar. 17, 2001

(65) Prior Publication Data

US 2002/0132089 A1 Sep. 19, 2002

(51) Int. Cl.[7] ..... B32B 3/04

(52) U.S. Cl. ..... 428/100; 428/74; 428/76; 428/99; 428/102; 428/603; 428/911; 2/2.5

(58) Field of Search ..... 428/74, 76, 99, 428/100, 911, 603, 102; 2/2.5

*Primary Examiner*—Alexander S. Thomas
(74) *Attorney, Agent, or Firm*—John J. Murphey

(57) ABSTRACT

The invention is a novel body armor that comprises a metallic layer having a surface contoured for close fitting to the wearer, the layer bounded by an outer perimeter, a second layer of organic material located adjacent the metallic layer, the layer of organic material having the same surface contour as the metallic layer, an inter-layer of releasably engageable fasteners inserted between the metallic layer and the organic material layer to form a multi-layer laminate, and a layer of semi-flexible plastic surrounding and in contact with the outer surfaces of the metallic layer, to form an armor unit cover.

17 Claims, 3 Drawing Sheets

TACTICAL BODY ARMOR

BACKGROUND OF THE INVENTION

1. Field of the Invention

This invention pertains to the field of armor. More particularly, it pertains to the field of body armor for protecting the human body from knife and bullet impacts and is so relatively light-weight that it may be worn without difficulty by the person seeking protection.

2. Description of the Prior Art

Whether we were originally pugnacious, or have evolved to that state over time, we now live in a combative society. We shoot and stab each other to settle disputes, to right alleged wrongs, and, often, for no real reason at all. It is not safe to travel in various parts of our cities. Even tourists to our country are in peril in many areas. In some activities, such as illegal drug dealing and bank robbery, the likelihood of being stabbed or shot is extremely high, even to innocent bystanders.

Historically, citizens have attempted to secure their personal safety by fashioning garments and other things that ward off penetration by knives and bullets. While the examples are numerous, the most practical means achieved thus far comprise panels made of strong fibers and other hard materials that resist penetration from knives and missiles. With modern guns and high speed bullets becoming more commonplace, the most popular armor has been a mixture of strong plastics and, in severe cases, plates of hard metal. However, strong plastic panels and hard metal plates are bulky and heavy and have not received wide acceptance. In addition, plastic panels and most metal panels cannot stop certain caliber of bullets fired at close range, such as the 7.62 mm, 124 gram FMJ lead-core ball round (7.62×39), popularly known as the AK-47 bullet, which has recently become the caliber of choice for illegal elements of our society.

SUMMARY OF THE INVENTION

This invention is a body armor that is novel in its construction and in its ability to stop penetration by high speed bullets, such as that fired from the AK-47, and by knives. It is rather simple in construction and yet is solid and long-lasting in design and use. In addition, the invention includes a novel method of manufacturing the body armor that is unique in the industry.

These and other objects of the invention will become more clear when one reads the following specification, taken together with the drawings attached hereto. The scope of protection sought by the inventor may be gleaned from a fair reading of the Claims that conclude this specification.

DESCRIPTION OF THE PREFERRED EMBODIMENT

Figure 1:
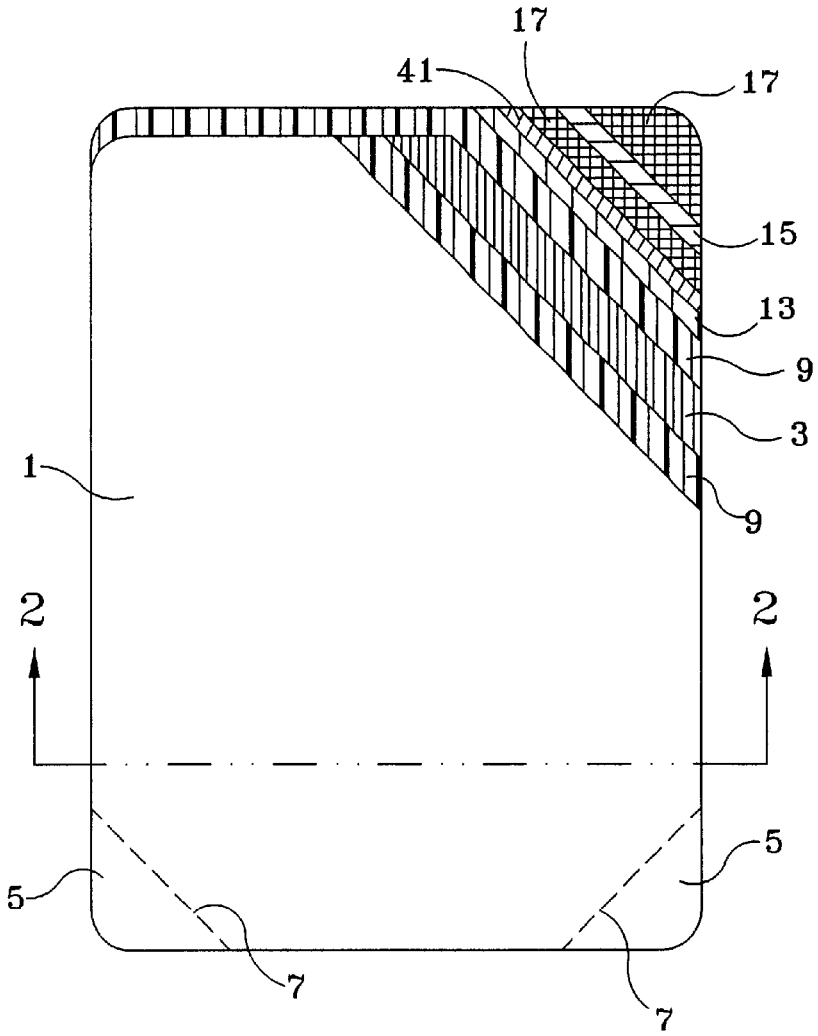
FIG. 1 is a top plan and partially sectional view of the preferred embodiment of this invention.
Figure 2:
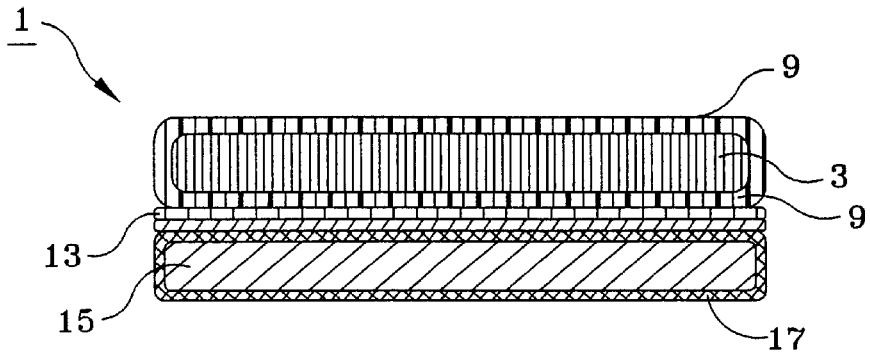
FIG. 2 is a cross-sectional view of the embodiment shown in FIG. 1.

Turning now to the drawings wherein elements are identified by numbers and different numbers are used throughout the five figures, the first preferred embodiment 1 of the invention is depicted in FIGS. 1 and 2 as a piece of novel body armor comprising a laminate of various materials. Beginning with the heaviest material, a first layer 3 is provided of a uniform thickness of metal, the metal preferably a nickel-chromium-molybdenum steel having a carbon content below 0.3%. This metal exhibits, at +20° C., a yield strength of about 1100 MPa, an ultimate tensile strength of about 1480 MPa, a percent elongation (5*d*) of about 9, a lengthwise KCV of 30 Joule/cm$^2$, a transverse KCV of 20 Joules/cm$^2$ and a Brinell hardness of about 470. At −40° C. it exhibits a lengthwise and a transverse KCV of 20 Joule/cm$^2$. This type of metal may be obtained at Creusot Loure Industrie, Cresusot Marrel Division, France, under the name, 240 MARS™ and will hereinafter be referred to as MARS™ metal. Layer 3 is characterized by having an outer-facing surface 3A and an inner-facing surface 3B and is contoured for close fitting to the body of the user.

Layer 3 is preferred to be made with uniform thickness throughout, such as 4 mm thick, and has bent edge portions 5, shown in FIGS. 1 and 2 made along fold lines 7, at an angle "α" where the angle is set at between 10° C. to 20° C. and more preferably at 11° 20 minutes. Bent edge portions 5 provide closer and more comfortable fitting of layer 3 to the wearer and acts to deflect bullets striking layer 3 in a harmless direction from the wearer.

First layer 3 is covered with a second thin (e.g. ⅛ inch thick) layer 9 of a cured semi-flexible plastic, such as polyvinyl chloride, to form an easily handleable product. The material is a plastisol PVC/VINYL liquid dip coating and can be obtained, for instance, from Diversified Compounders, Inc., 5701 E. Union Pacific Ave., Los Angeles, Calif. 90022. The specific material desired is a black dip, having a density of 10.36 at 100% solids, having a cure cycle of 350°–400° F., a cured tensile strength of 1800–2000 psi and a tear strength of 198 pli.

The front surface of layer 9 faces outward from the user. The rear surface of layer 9 is striped with strips of upstanding hook elements 13 adhered to said surface by glue or other such adhesive and about which more will be said later in this specification. A third layer or mat 15 of organic fiber material is provided having the same surface contour as first layer 3. It is preferred that the organic material making up third layer 15 comprises a laminate containing at least about 30 layers of a fire retardant, high strength, micro-filament, hi-tenacity fiber fabric, such as Twaron®1000, sewn in one-inch quilt pattern. This material can be obtained, for instance, from Barrday, Inc., 75 Moorefield Street., P.O. Box 790, Cambridge, ON N1R 56 Canada under description FN 2167/160 and has a weight of about 8.5 ounces per yard$^2$, a width of about 62 inches, and a thread count of about 22 yarns per inch in warp and 22 yarns per inch in weft. The thread from which it is made contains about 500 filaments, and has a strength at break of about 144,444, a tenacity at break of 1719 mN/tex, an elongation at break of about 2.90% and a chord modulus of about 72 Gpa.

A cloth cover 17, such as nylon woven polyamide thread cloth, is placed about all surfaces of mat 15 and sewn together to tightly encapsulate the Twaron 1000. On one broad surface of cloth cover 17, covering a broad surface of mat 15, is placed a plurality of strips of releasably engageable polymeric inter-engageable loop-type fastening elements 19, arranged in the same format as strips of hook elements 13 and adhered tightly to said cloth by glue or other adhesive. Hook elements 13 and loop elements 19 are resilient and deformable and, when pressed together, become intimately entangled, securing strips 13 and 19 together in tight engagement. Strips 13 and 19 can be released from entangled engagement by positively pulling hook elements 13 away from loop elements 19 or vice versa. The loop and hook fabric elements 13 and 19 are available under the trademark "Velcro®", more specific details of which may be had from U.S. Pat. No. 2,717,437 titled VELVET TYPE FABRIC AND METHOD OF PRODUCING SAME issued Sep. 13, 1955 to George de Mestral and U.S. Pat. No. 3,114,951 titled DEVICE FOR JOINING TWO FLEXIBLE ELEMENTS issued Dec. 24, 1963 to George de Mestral. The material is hereinafter referred to as "Velcro®" loop material and "Velcro®" hook material, a product of American Velcro, Inc.

This embodiment of the invention is generally made in varying sizes to fit people of varying stature. For instance, the invention may be purchased in sizes of 10 inches by 12 inches where the device weighs 6.9 pounds. Other sizes are available: 8"×10" (4.6 lbs.), 6"×8" (2.5 lbs), and 5"×8" (2.3 lbs). The suggested method of application is to wear the device with the steel plate (layer 3) on the outside. It is a strong armor package that efficiently deflects penetration of missiles and knives.

Figure 3:
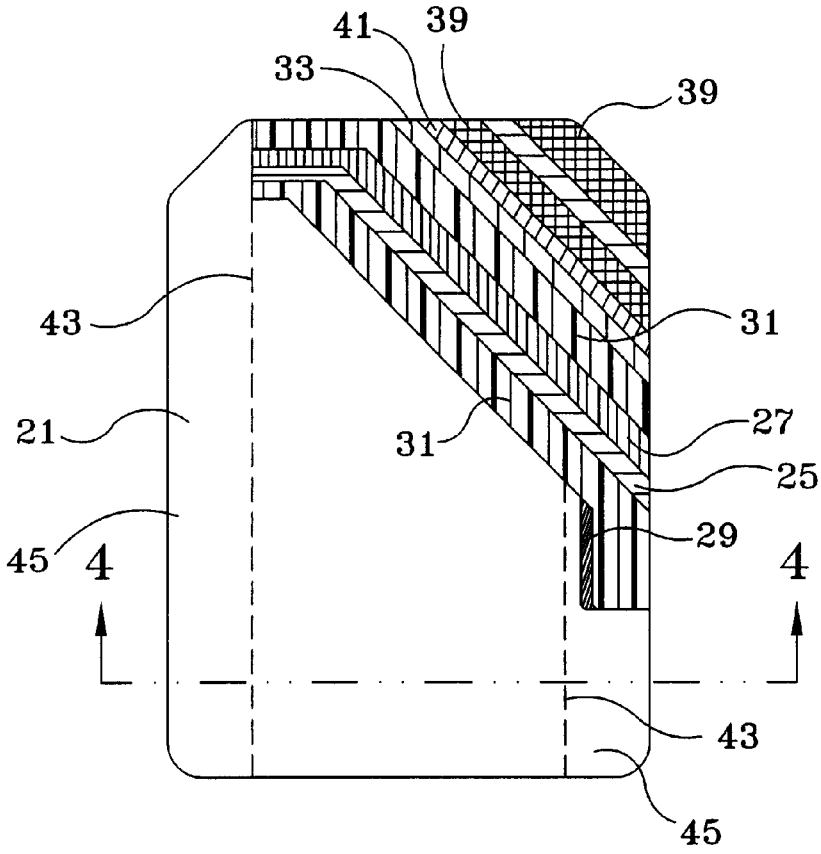
FIG. 3 is a top plan and partially sectional view of another embodiment of this invention.
Figure 4:
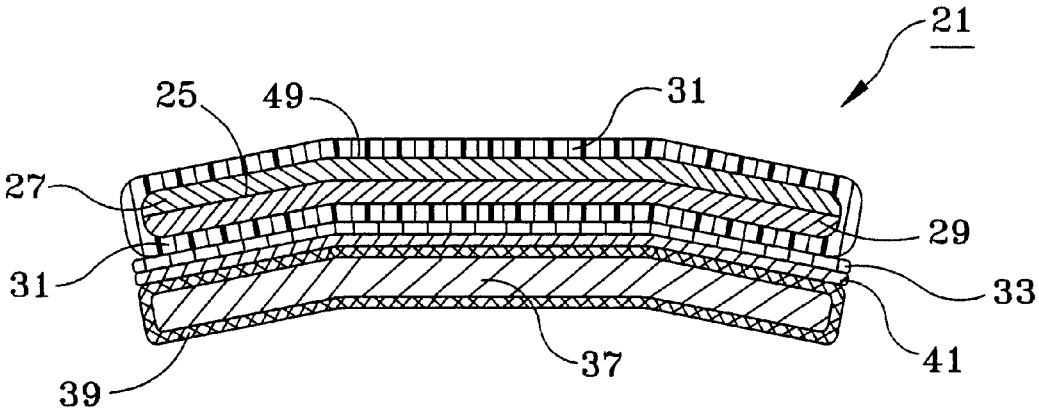
FIG. 4 is a cross-sectional view of the embodiment shown in FIG. 3; and, FIG. 5 is a top plan and partially sectional view of still another embodiment of this invention.

As shown in FIGS. 3 and 4, a second embodiment 21 of the invention is shown, said embodiment being thicker and having different bends, and is sold under the trademark "LifeSaver Max". This embodiment comprises a thicker plate of metal, such as two 4 mm-thick layers 25 and 27, of metal such as 240 MARS™ to make an 8-mm thick layer fastened together such as by a bead of welding 29 about the perimeters thereof. Also in this embodiment, layers 25 and 27 are covered with a thin layer 31 of plastisol resin as aforesaid. The plastisol resin coating is thought to aid in deflecting bullets and knife strikes by slowing down the incoming projectile as well as softening the shock of incoming projectiles to the body.

A plurality of strips of releasably engageable polymeric inter-engageable hook-type fastening elements 33 is provided and arranged on the rearward-facing surface of the thick metal layer. A mat 37 containing at least about 30 layers of a fire retardant, high strength, micro-filament, hi-tenacity fiber fabric, such as Twaron®1000, is provided and sewn in a one-inch quilt pattern. A cloth cover 39, such as nylon woven polyamide thread cloth, is placed about all surfaces of mat 37 and sewn together to tightly encapsulate the Twaron 1000. On one broad surface of cloth cover 39, covering a broad surface of mat 37, is placed a plurality 41 of strips of releasably engageable polymeric inter-engageable loop-type fastening elements, arranged in the same format as strips of hook elements 33 and adhered tightly to said cloth by glue or other adhesive. Hook elements 33 and loop elements 41 are resilient and deformable and, when pressed together, become intimately entangled, securing them together in tight engagement.

The bends in this second embodiment are the same as in first embodiment 1, except fold lines 43 are parallel to each other and form side panel narrow portions 45 of a thicker plate of metal layer 3 and are bent to angles of 11° 20 minutes. Bent panels also aid in deflecting incoming projectiles to the body.

This embodiment of the invention is also generally made in varying sizes to fit men and women of varying stature. For instance, the invention maybe purchased in sizes of 10 inches by 12 inches where the device weighs 6.9 pounds. Other sizes are available, such as 6"×9". The suggested method of application is to wear the device with the steel plate (layers 25 and 27) on the outside of one's body.

Figure 5:
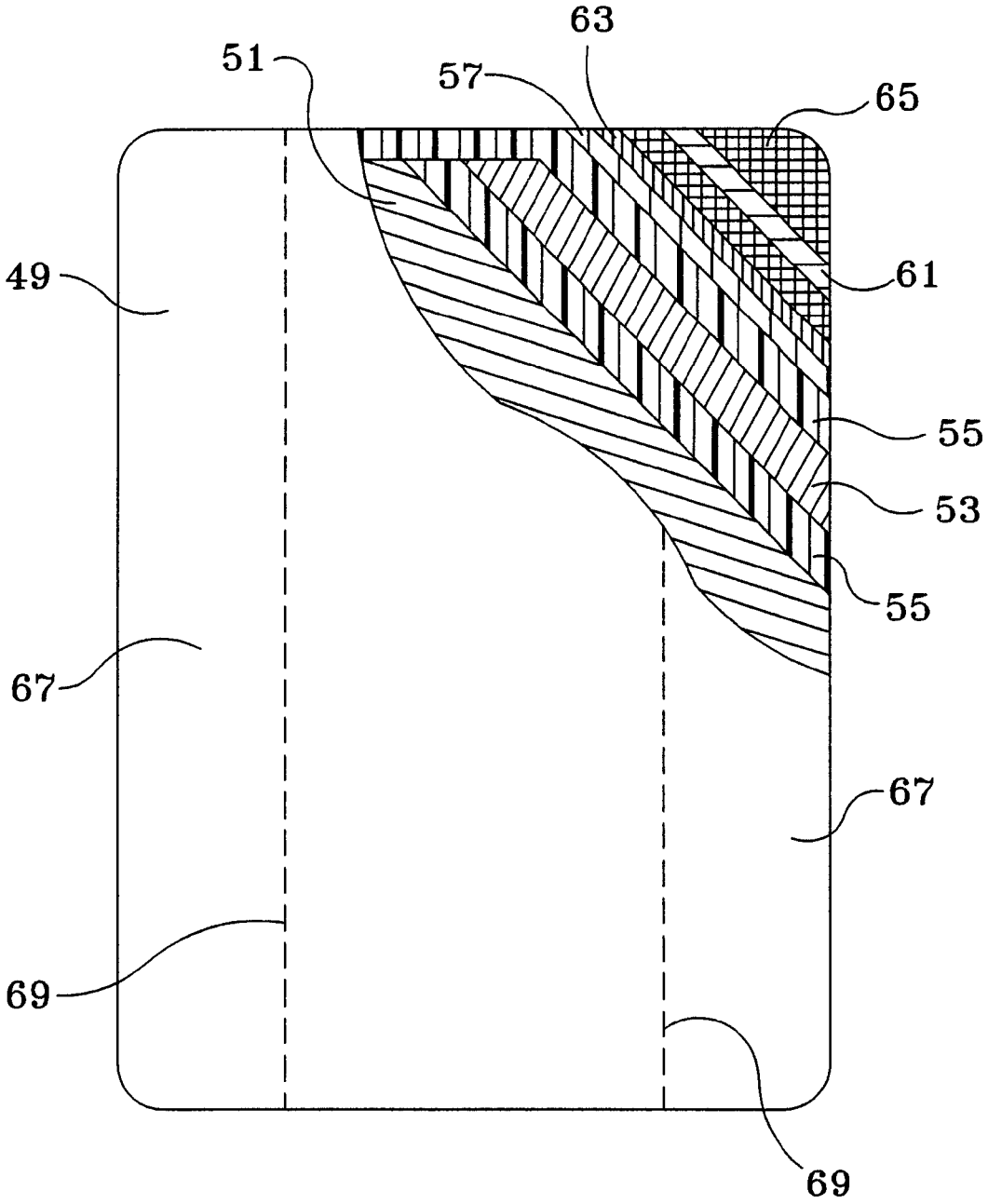

As shown in FIG. 5, a third embodiment 49 of the invention is shown, said embodiment being of different construction than the other two embodiments. This embodiment comprises a first or outside layer 51 of organic material containing at least about 7 layers of a fire retardant, high strength, micro-filament, hi-tenacity fiber fabric, such as Twaron®1000, sewn in one-inch quilt pattern. Next is a thin, such as 4 mm thick, layer 53 of MARS™ metal surrounded with a layer 55 of plastisol PVC plastic as afore described. To the inside surface of plastisol layer 55 is placed a plurality of strips of polymeric hook elements 57 such as "Velcro®" as afore described. Next is provided a pad 61 of at least about 30 layers of a fire retardant, high strength, micro-filament, hi-tenacity fiber fabric, such as Twaron®1000, sewn in one-inch quilt pattern. On one broad surface of pad 61 is placed a plurality of strips 63 of polymeric loop elements, arranged in the same format as strips of hook elements 57. These strips, 57 and 63, serve to hold pad 61 tightly against plastisol layer 55. A cloth cover 65, such as a nylon woven polyamide thread cloth, is placed about all surfaces of mat 51 and sewn together to encapsulate all of the layers therein.

This embodiment of the invention is also generally made in varying sizes to fit men and women of varying stature. For instance, the invention may be purchased in sizes of 10 inches by 12 inches where the device weighs 6.9 pounds. Other sizes are available such as 6"×9". The suggested method of application is to wear the device with the steel plate (layers 25 and 27) on the outside of one's body.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve substantially the same result are within the scope of this invention.

What is claimed is:

1. Novel body armor comprising:

a) a first outer metallic layer having a surface contoured for close fitting to the wearer, said layer bounded by an outer perimeter and having a first, outer-facing surface and a second, inner-facing surface;

b) a second layer of organic plastisol material adjacent to and covering all surfaces of said first metallic layer and adhered thereto, said layer of organic material having the same surface contour as said first metallic layer;

c) a first plurality of strips of releasably engageable polymeric inter-engageable loop and hook type fasteners, in tight adherence to said inner-facing surface of said organic plastisol material covering said first metallic layer; and, d) a third layer of a mat of organic fiber material, of the same size and same shape as said first layer, arranged inside a cloth bag that is sewn tightly thereabout and covered on one broad surface with a second plurality of strips of releasably engageable polymeric inter-engageable hook and loop type fasteners, in tight adherence to said cloth bag and all said layers arranged in laminate form and said first and said second plurality of inter-engageable fasteners inter-engaged to form a strong armor package to deflect penetration of missiles and knives.

2. The novel body armor of claim 1 wherein said first outer metallic layer comprises a layer of nickel-chromium-molybdenum alloy containing no more than 0.3% carbon.

3. The novel body armor of claim 1 wherein said first metallic layer is of uniform thickness.

4. The novel body armor of claim 1 wherein said contour of said first outer metallic layer contains at least one fold line providing a body contoured for close fitting to the user of said armor.

5. The novel body armor of claim 1 further including a second metallic layer adjacent said first outer metallic layer having a surface contoured for close fitting to the wearer, and bounded by an outer perimeter adhered thereto and further including a mat of at least about 30 layers of a fire retardant, high strength, micro-filament, hi-tenacity fiber fabric.

6. The novel body armor of claim 1 wherein said first metallic layer is comprised of a 4-mm thick layer of a nickel-chromium-molybdenum steel having a carbon content below 0.3%, exhibits, at +20° C., a yield strength of about 1100 MPa, an ultimate tensile strength of about 1480 MPa, a percent elongation (5d) of about 9, a lengthwise KCV of 30 Joule/cm$^2$, a transverse KCV of 20 Joules/cm$^2$, a Brinell hardness of about 470, and at −40° C. exhibits a lengthwise and a transverse KCV of 20 Joule/cm$^2$.

7. The novel body armor of claim 1 wherein said second organic layer is comprised of a fire retardant, high strength, micro-filament, hi-tenacity fiber fabric, having a weight of about 8.5 ounces per yard$^2$, a width of about 62 inches, a thread count of about 22 yarns per inch in warp and 22 yarns per inch in weft, containing about 500 filaments, a strength at break of about 144,444, a tenacity at break of 1719 mN/tex, an elongation at break of about 2.90%, and a chord modulus of about 72 Gpa.

8. Novel body armor comprising:

a) a first outer metallic layer comprising two independent layers of the same type metal formed in close-fitting contour, having an exterior surface contoured for close fitting to the wearer, each said layer bounded by an outer perimeter wherein said perimeters are welded together and said first outer metallic layer has a first, outer-facing surface and a second, inner-facing surface;

b) a second layer of organic plastisol material adjacent to and covering all exterior surfaces of said first outer metallic layer and adhered thereto, said layer of organic material having the same overall surface contour as said first outer metallic layer;

c) a first plurality of strips of releasably engageable polymeric inter-engageable loop and hook type fasteners, in tight adherence to said inner-facing surface of said second layer of said organic plastisol material covering said first outer metallic layer; and, d) a third layer of a mat of organic fiber material, of the same size and shape as said first outer metallic layer, arranged inside a cloth bag that is sewn tightly thereabout and covered on one broad surface with a second plurality of strips of releasably engageable polymeric inter-engageable hook and loop type fasteners, in tight adherence to said cloth bag and all said layers arranged in laminate form and said first and said second plurality of inter-engageable fasteners inter-engaged to form a strong armor package to deflect penetration of missiles and knives.

9. The novel body armor of claim 8 wherein said metallic layer comprises two layers of nickel-chromium-molybdenum alloy each said layer containing no more than 0.3% carbon.

10. The novel body armor of claim 8 wherein said metallic layers are of uniform thickness.

11. The novel body armor of claim 8 wherein said contours of said metallic layers contain at least one fold line providing a body contoured for close-fitting to the wearer of said armor.

12. The novel body armor of claim 8 wherein said metallic layer is comprised of an 8-mm layer of a nickel-chromium-molybdenum steel having a carbon content below 0.3%, exhibits, at +20° C., a yield strength of about 1100 MPa, an ultimate tensile strength of about 1480 MPa, a percent elongation (5d) of about 9, a lengthwise KCV of 30 Joule/cm$^2$, a transverse KCV of 20 Joules/cm$^2$, a Brinell hardness of about 470, and at −40° C. exhibits a lengthwise and a transverse KCV of 20 Joule/cm$^2$.

13. Novel body armor comprising:

a) a first layer of a mat of organic fiber material having a first, outer-facing surface and a second, inner-facing surface;

b) a second layer of a plate of metal having a surface contoured for close fitting to the wearer, said layer bounded by an outer perimeter and having a first, outer-facing surface facing said inner-facing surface of said first layer, and a second, inner-facing surface;

b) a third layer of organic plastisol material adjacent to and covering all surfaces of said second metal plate layer and adhered thereto, said layer of organic material having the same surface contour as said second metal plate layer and having an inner-facing surface;

c) a first plurality of strips of releasably engageable polymeric inter-engageable loop and hook type fasteners, in tight adherence to said inner-facing surface of said organic plastisol material;

d) a fourth layer of a mat of organic fiber material, of the same size and shape as said first and second layers, and covered on one broad surface with a second plurality of strips of releasably engageable polymeric inter-engageable hook and loop type fasteners, and all said layers arranged in laminate form and wherein said first and second plurality of inter-engageable fasteners are inter-engaged; and, e) a cloth bag that is sewn tightly about the entire laminate to form a strong armor package to deflect penetration of missiles and knives.

14. The novel body armor of claim 13 wherein said metallic layer comprises two layers of nickel-chromium-molybdenum alloy each said layer containing no more than 0.3% carbon.

15. The novel body armor of claim 13 wherein said second layer of a plate of metal includes an additional layer of a plate of metal and wherein said second layer and said additional layer of metal are of uniform thickness.

16. The novel body armor of claim 15 wherein said contours of said metallic layers contain at least one fold line providing a body contoured for close-fitting to the wearer of said armor.

17. The novel body armor of claim 13 wherein said metallic layer is comprised of an 8-mm layer of a nickel-chromium-molybdenum steel having a carbon content below 0.3%, exhibits, at +20° C., a yield strength of about 1100 MPa, an ultimate tensile strength of about 1480 MPa, a percent elongation (5d) of about 9, a lengthwise KCV of 30 Joule/cm$^2$, a transverse KCV of 20 Joules/cm$^2$, a Brinell hardness of about 470, and at −40° C. exhibits a lengthwise and a transverse KCV of 20 Joule/cm$^2$.

* * * * *